US011950649B2

(12) United States Patent
Toratani

(10) Patent No.: US 11,950,649 B2
(45) Date of Patent: Apr. 9, 2024

(54) UPPER BODY OF GARMENT

(71) Applicant: Toratani Co., Ltd., Kahoku (JP)

(72) Inventor: Ikuo Toratani, Kahoku (JP)

(73) Assignee: TORATANI CO., LTD., Kahoku (JP)

( * ) Notice: Subject to any disclaimer, the term of this patent is extended or adjusted under 35 U.S.C. 154(b) by 333 days.

(21) Appl. No.: 17/430,989

(22) PCT Filed: Feb. 18, 2019

(86) PCT No.: PCT/JP2019/005767
§ 371 (c)(1),
(2) Date: Aug. 13, 2021

(87) PCT Pub. No.: WO2020/170292
PCT Pub. Date: Aug. 27, 2020

(65) Prior Publication Data
US 2022/0175070 A1 Jun. 9, 2022

(51) Int. Cl.
*A41D 27/10* (2006.01)
*A41B 1/08* (2006.01)

(52) U.S. Cl.
CPC ..... *A41D 27/10* (2013.01); *A41B 1/08* (2013.01)

(58) Field of Classification Search
CPC .... A41D 27/10; A41D 27/00; A41D 2400/38; A41B 1/00; A41B 1/08; A41B 9/06; A41B 2400/32; A41B 2400/38; A41B 2300/22; A61F 5/026
USPC ..... 2/115, 117, 122, 125, 44
See application file for complete search history.

(56) References Cited

U.S. PATENT DOCUMENTS 5,937,442 A 8/1999 Yamaguchi et al.
8,083,693 B1 * 12/2011 McKeon ..... A61B 5/6805 600/595
2010/0010568 A1 * 1/2010 Brown ..... A61H 1/008 2/69
2010/0050313 A1 * 3/2010 Shackelford, Jr. ..... A41D 13/1245 2/243.1
2010/0256717 A1 10/2010 Brown
2011/0131697 A1 * 6/2011 Kawahara ..... A61F 5/01 2/44

(Continued)

FOREIGN PATENT DOCUMENTS

CN 1181692 A 5/1998
JP 2005-299023 10/2005

(Continued)

OTHER PUBLICATIONS

International Search Report, dated May 14, 2019, 1 page.

(Continued)

*Primary Examiner* — Jameson D Collier
(74) *Attorney, Agent, or Firm* — Rankin, Hill & Clark LLP

(57) ABSTRACT

An upper body of a garment includes a body having at least a rear body, a left sleeve, and a right sleeve. The left sleeve includes a left connecting portion connected to a left side of the body. The right sleeve includes a right connecting portion connected to a right side of the body. Each rear surface of the left connecting portion and the right connecting portion has a recess protruding to the inside of the left or right sleeve. A length of the recess in a longitudinal direction of the left or right sleeve is longer than a width of the recess in a circumferential direction of the left or right sleeve.

16 Claims, 7 Drawing Sheets

(56) References Cited

U.S. PATENT DOCUMENTS

2012/0150085 A1* 6/2012 Kayser ..... A61F 5/026 602/19
2012/0311760 A1* 12/2012 Puni ..... A41D 13/0512 2/69
2013/0012853 A1* 1/2013 Brown ..... A41C 3/0057 602/19
2014/0174454 A1* 6/2014 Naef ..... A61F 5/3723 128/845
2014/0196190 A1* 7/2014 Brown ..... A41C 3/0057 2/69
2014/0317826 A1* 10/2014 Decker ..... A41D 13/0015 2/69
2015/0040286 A1* 2/2015 Schultz ..... A61F 5/026 2/88
2015/0237921 A1* 8/2015 Uttich ..... A41D 31/12 2/69
2016/0113806 A1* 4/2016 Lyu ..... A41B 9/04 450/96
2016/0183606 A1* 6/2016 Shriver ..... A63B 21/0552 2/69
2017/0216077 A1* 8/2017 Chahrour ..... A61F 5/028
2017/0231798 A1* 8/2017 Shin ..... A41D 31/18 2/44
2018/0317562 A1* 11/2018 Gagliardo ..... A41B 1/08
2019/0254856 A1* 8/2019 Liu ..... A41B 1/08
2020/0128893 A1* 4/2020 Pihl ..... A41B 9/06
2021/0368897 A1 12/2021 Toratani

FOREIGN PATENT DOCUMENTS

JP 2010-275662 A 12/2010
JP 3175207 4/2012
JP 2013-503268 1/2013
JP 2014-196587 10/2014
KR 10-0688358 B1 3/2007
WO 2010/100721 A1 9/2010
WO 2019/016973 A1 1/2019

OTHER PUBLICATIONS

Chinese Office Action dated Jan. 19, 2023, Chinese Application No. 2019800909, English translation included, 15 pages.
Korean Office Action dated Nov. 28, 2023, Korean Application No. 10-2021-7018217, English translation included, 12 pages.

* cited by examiner

UPPER BODY OF GARMENT

TECHNICAL FIELD

The invention relates to upper bodies of garments.

BACKGROUND ART

An upper body of a garment is known, which can cover at least a portion of the upper body of a wearer. See Patent Literature 1, for example.

CITATION LIST

Patent Literature

Patent Literature 1: JP 2014-196587 A

SUMMARY OF INVENTION

When operating a mobile device such as a smartphone, a person tends to move his/her shoulder forward from a position in a good posture to put his/her arm holding the mobile device in front of his/her trunk. The term "good posture" concretely means a posture with which a person standing on a flat surface, when viewed side on, puts the root of his/her neck and his/her shoulders, elbows, and ankles in a substantially straight line. Frequent repetition or long-time maintenance of a posture in which the shoulders are placed in front of the position in the good posture can lead to deterioration of the body shape such as rounded shoulders or kyphosis. The term "rounded shoulders" means a body shape in which shoulder blades are placed far apart from each other to rotate the shoulders inward. The term "kyphosis" means a body shape in which the spine has an excessive forward curvature to put the head in a forward position. These body shapes can cause pain such as stiff shoulders.

In view of the above-mentioned problems, the invention is devised. An object of the invention is to provide an upper body of a garment that can make it difficult for a wearer to adopt the posture in which the shoulders extend forward to put his/her arms in front of the trunk.

An upper body of a garment according to one aspect of the invention includes a body having at least a rear body, a left sleeve, and a right sleeve. The left sleeve includes a left connecting portion connected to a left side of the body, and the right sleeve includes a right connecting portion connected to a right side of the body. Each rear surface of the left connecting portion and the right connecting portion has a recess protruding to the inside of the left or right sleeve. A length of the recess in a longitudinal direction of the left or right sleeve is longer than a width of the recess in a circumferential direction of the left or right sleeve.

When a wearer with the good posture moves, for example, the left arm forward, he/she has to first flatten the recess in the rear surface of the left connecting portion, and thus the left arm experiences resistance, which prevents the left arm from involuntarily moving forward from the position in the good posture. The same is true for the right arm. Accordingly, it is difficult for the wearer to adopt the posture in which the shoulders extend forward to put the arms in front of the trunk.

The left sleeve may include a hardly-stretchy region that, when being stretched by 20% in the longitudinal direction of the left sleeve, increases a stretching force to 45 cN or more in the same direction and that extends at least within the rear surface of the left connecting portion. The right sleeve may include a hardly-stretchy region that, when being stretched by 20% in the longitudinal direction of the right sleeve, increases a stretching force to 45 cN or more in the same direction and that extends at least within the rear surface of the right connecting portion. The hardly-stretchy region of the left sleeve may range from the rear surface of the left connecting portion to a front surface thereof. The hardly-stretchy region of the right sleeve may range from the rear surface of the right connecting portion to a front surface thereof. Note that the "stretching force" is a force that a constant-rate-loading tensile machine needs to stretch a piece of fabric, which is 10 cm long and 2.5 cm wide, in its longitudinal direction at a rate of 30 cm/min under the condition of about 20 degrees Celsius, i.e. 18-22 degrees Celsius. As the constant-rate-loading tensile machine, an AGS-X manufactured by Shimadzu corporation was used to measure values of stretching force described herein. Due to the presence of the hardly-stretchy region, each of the left and right connecting portions generates a high tensile force once it is stretched, and thus it hardly or never reduces the resistance caused by flattening the recess of its rear surface. As a result, the garment can effectively prevent the forward motion of the wearer's shoulder blades, upper arms, and shoulders.

Instead of the hardly-stretchy region, the left and right sleeves may each include a non-stretchy region, which is stretched by less than 20% in the longitudinal direction of the left or right sleeve when experiencing a stretching force of 45 cN or more in the same direction. The non-stretchy regions of the left and right sleeves may extend at least within the rear surfaces of the left and right connecting portions, respectively. The non-stretchy region of the left sleeve may range from the rear surface of the left connecting portion to a front surface thereof. The non-stretchy region of the right sleeve may range from the rear surface of the right connecting portion to a front surface thereof. According to these structures, any of the left and right connecting portions is hardly or not substantially stretched, thus hardly or never reducing the resistance caused by flattening the recess of its rear surface. As a result, the garment can effectively prevent the forward motion of the wearer's shoulder blades, upper arms, and shoulders.

The left and right connecting portions may each extend backward from the rear body. In this case, even when the wearer adopts the good posture, the arms are pulled backward. Accordingly, it is more difficult for the wearer to adopt the posture in which the shoulders extend forward to put the arms in front of the trunk.

The rear body may include a restricting portion located between the rear surfaces of the left and right sleeves and preventing the left and right shoulder blades of the wearer from moving apart from each other. The restricting portion may be integrated with the rear body. The words "integrated with" may mean that the fabric of the restricting portion is sewn and connected to the fabric of one or more of other regions of the rear body, or that the restricting portion and one or more of other regions of the rear body are woven into a single fabric. Alternatively, the restricting portion may include an additional fabric attached to the rear body and different from the fabric of the rear body. The additional fabric may be sewn on the boundary between each rear surface of the left and right sleeves and the rear body, or on each rear surfaces of the left and right sleeves. Due to resistance of the restricting portion, it is more difficult for the wearer to adopt the posture in which the shoulders extend forward to put the arms in front of the trunk.

The upper body of the garment according to the above-described aspect of the invention makes the wearer with the good posture, when moving any of the left and right arms forward, experience the resistance by the recess of the corresponding left and right connecting portions. Accordingly, any of the arms is unlikely to involuntarily move forward from the position in the good posture. Thus, the upper body of the garment can make it difficult for the wearer to adopt the posture in which the shoulders extend forward to put the arms in front of the trunk.

DESCRIPTION OF EMBODIMENTS

Embodiments of the invention will be explained with reference to the drawings.

Figure 1:
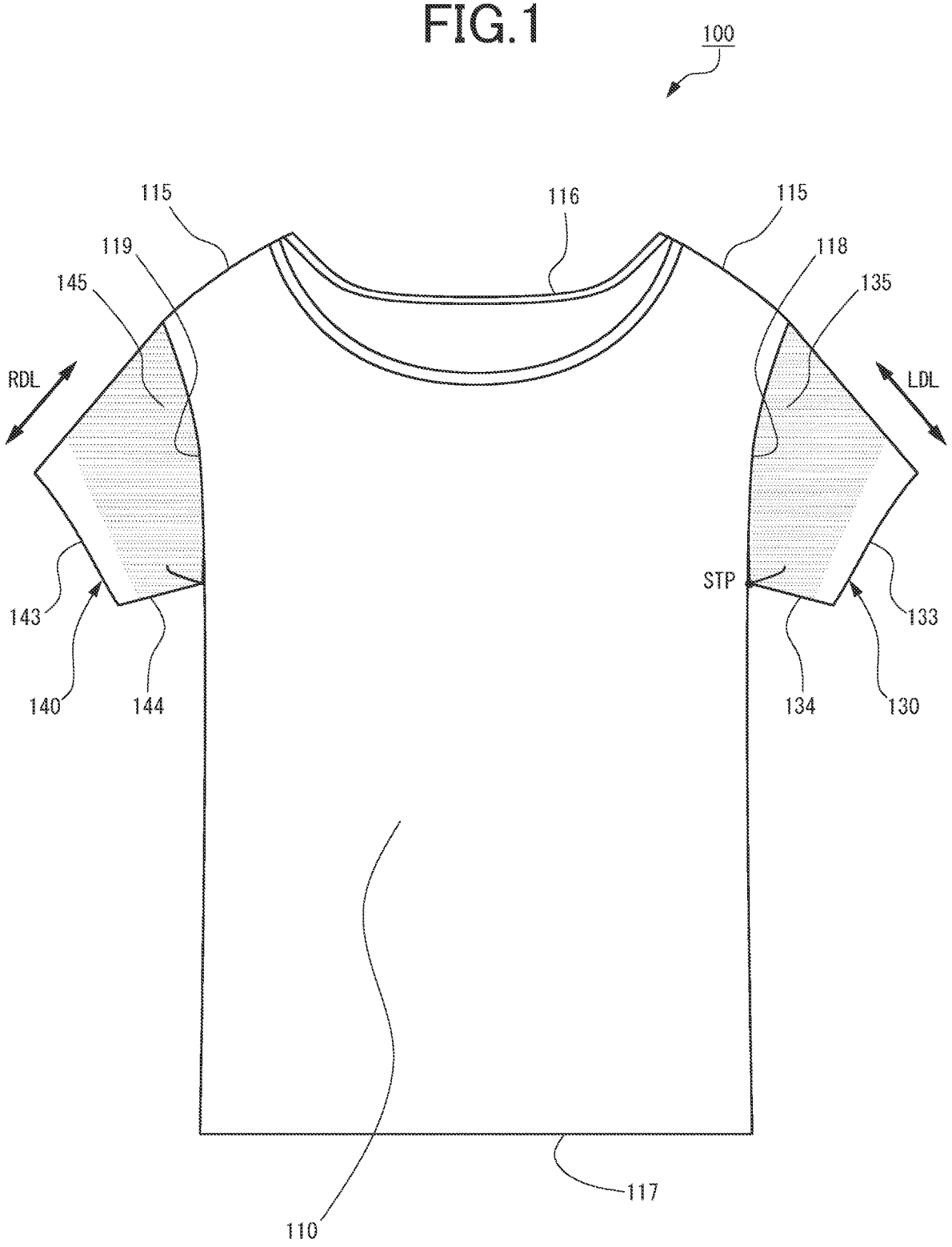
FIG. 1 is a front elevation view of an upper body of a garment according to an embodiment of the invention.
Figure 2:
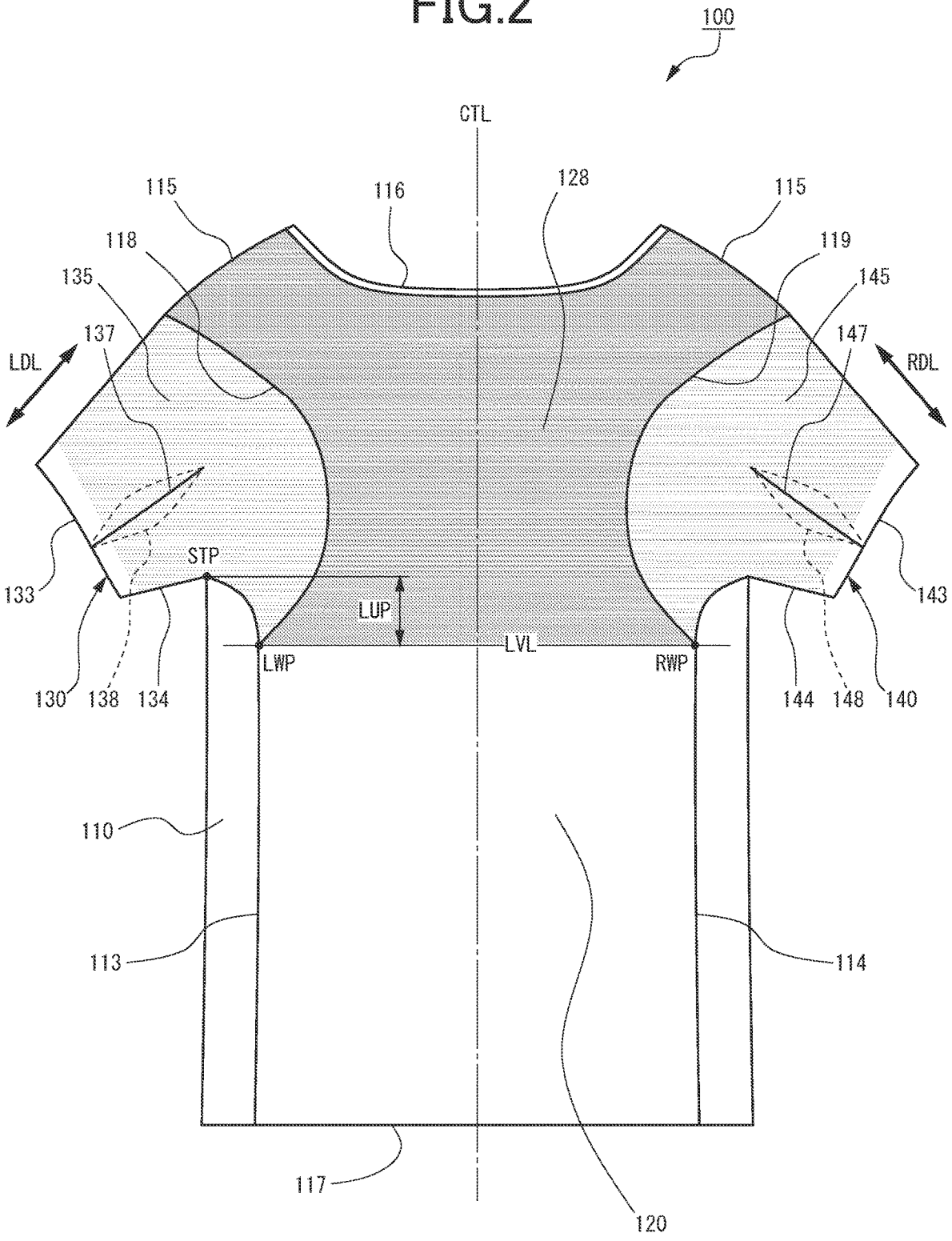
FIG. 2 is a rear elevation view of the upper body of the garment shown in FIG. 1.

FIGS. 1 and 2 are, respectively front and rear elevation views of an upper body of a garment 100 according to an embodiment of the invention. Hereinafter, the upper body of the garment 100 is referred to as "garment upper body," and left-right directions are determined with respect to a wearer of the garment upper body 100. For example, "left directions" described hereinafter are shown as a right direction in FIG. 1, while shown as a left direction in FIG. 2.

The garment upper body 100 is configured to wrap an upper portion of the wearer's trunk and his/her upper arms. For example, the garment upper body 100 is a short-sleeved shirt, but a garment upper body according to the invention may be an undergarment (innerwear) or an intermediate or outer garment (outerwear). The garment upper body 100 includes a body 110, 120, a left sleeve 130, and a right sleeve 140.

The body 110, 120 has a shape of a large-diameter cylinder to wrap the upper portion of the wearer's trunk. The body includes a front body 110 and a rear body 120. The front body 110 is a portion of the body that faces a front surface of the upper portion of the wearer's trunk, i.e. the wearer's chest and belly and covers the almost entirety of the front surface. The rear body 120 is a portion of the body that faces a rear surface of the upper portion of the wearer's trunk, i.e. the wearer's back and covers the almost entirety of the rear surface. The front body 110 and the rear body 120 each has a bilaterally symmetrical shape.

The left sleeve 130 and the right sleeve 140 are sewn on left and right sides of the body, respectively. Each of the sleeves 130 and 140 has a shape of a small-diameter cylinder to wrap an upper portion of the wearer's left or right upper arm. Each of the sleeves 130 and 140 includes a cuff 133, 143 and a connecting portion 135, 145 (which is also referred to as "sleeve cap"). The cuff 133, 143 corresponds to an open distal end of the cylindrical shape of each sleeve 130, 140, and the connecting portion 135, 145 corresponds to an open proximal end thereof. The connecting portion 135, 145 covers, especially, a shoulder of the wearer (cf. sparsely dotted regions shown in FIGS. 1 and 2). Each size of the sleeves 130, 140 can be freely designed in a longitudinal direction thereof (the direction of an arrow LDL or RDL shown in FIGS. 1 and 2). In FIGS. 1 and 2, both the sleeves 130 and 140 are designed as a short sleeve. Alternatively, the sleeves 130 and 140 may be designed as a long or three-quarter sleeve.

The front body 110 and the rear body 120 are sewn on each other to form a left side seam 113, a right side seam 114, and shoulder seams 115. The body thus includes a neckline 116, a hem 117, a left armhole 118, and a right armhole 119. The neckline 116 corresponds to an upper open end of the cylindrical shape of the body, and the hem 117 corresponds to a lower open end thereof. The left armhole 118 is the rim of a hole opened at an upper left side of the body, and the right armhole 119 is the rim of a hole opened at the upper right side of the body. On the left armhole 118, the connecting portion 135 of the left sleeve 130 (which is hereinafter referred to as "left connecting portion") is sewn. On the right armhole 119, the connecting portion 145 of the right sleeve 140 (which is hereinafter referred to as "right connecting portion") is sewn.

The fabric constituting the front body 110 may be extensible or not. The fabric constituting the rear body 120 is extensible, but a region 128 of the rear body 120 between the left sleeve 130 and the right sleeve 140 (cf. a densely dotted region shown in FIG. 2) consists of hardly- or non-stretchy fabric. The term "hardly-stretchy" means that the fabric is hardly stretched, or more concretely, the fabric increases a stretching force to 45 cN or more in a right and left direction when being stretched by 20% in the same direction. The term "non-stretchy" means that the fabric is almost or substantially inextensible, or more concretely, the fabric is stretched by less than 20% in a right and left direction when experiencing a stretching force of 45 cN or more in the same direction. Due to the hardly- or non-stretchy fabric, this region 128 can generate a higher reaction force against an external tensile force than other regions of the rear body 120 can. This region 128 is hereinafter referred to as "restricting portion". The restricting portion 128 is located above a horizontal line LVL connecting the upper end LWP of the left side seam 113 with the upper end RWP of the right side seam 114. On the left side of the restricting portion 128, the rear surface of the left connecting portion 135 is sewn, and on the right side of the restricting portion 128, the rear surface of the right connecting portion 145 is sewn. When being stretched by the rear surfaces of the left connecting portion 135 and the right connecting portion 145 in a right and left direction, the restricting portion 128 exerts high reaction forces on both the rear surfaces thereof. The restricting portion 128 can thus prevent the wearer's shoulder blades from moving apart from each other.

Figure 3:
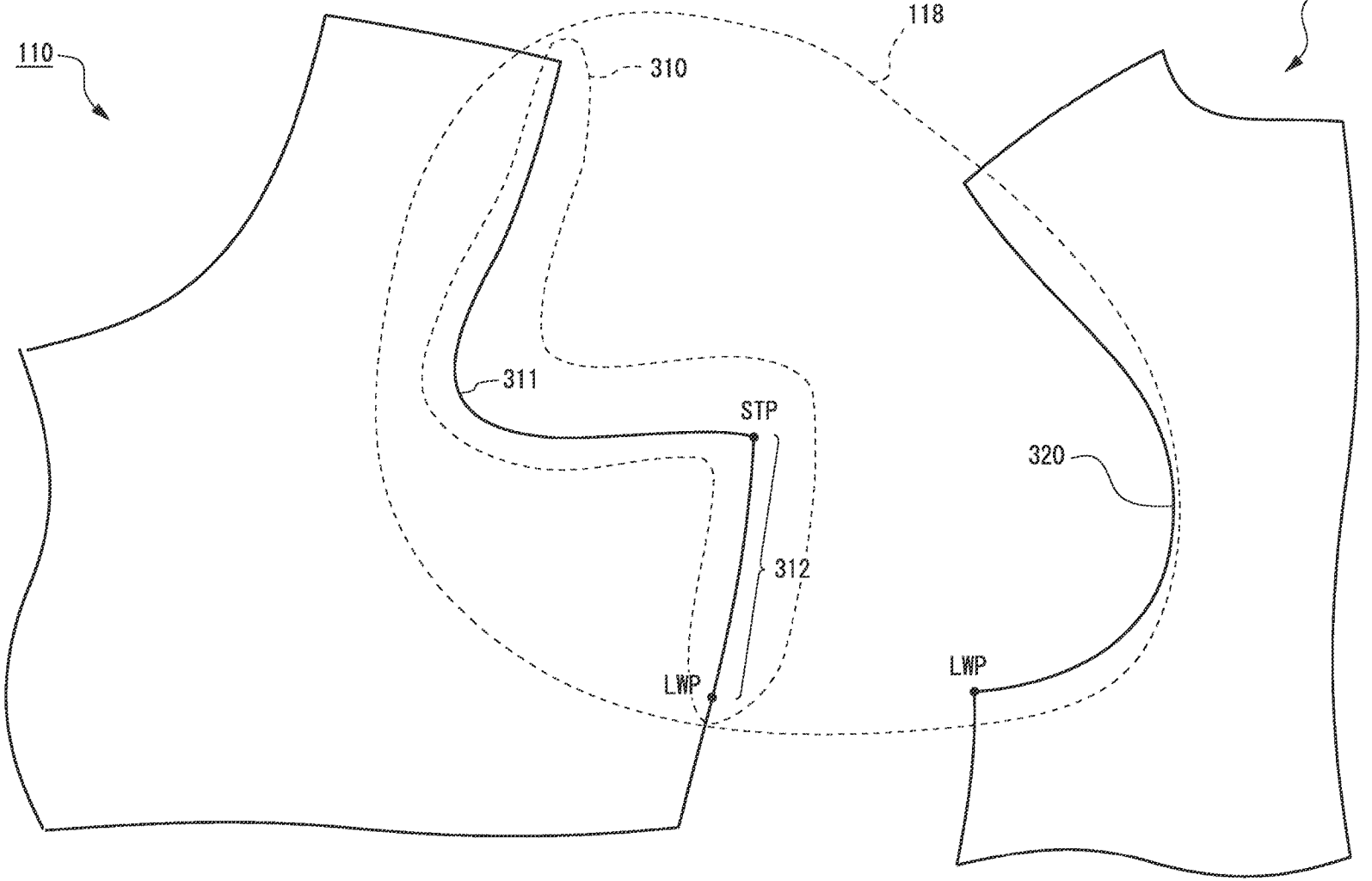
FIG. 3 is a partial development view of a left armhole and its vicinity in the front and rear bodies shown in FIGS. 1 and 2.

FIG. 3 is a partial development view of the left armhole 118 and its vicinity in the front body 110 and the rear body 120. Since a partial development view of the right armhole 119 and its vicinity is equivalent to a mirror image of FIG. 3, the following will explain the left armhole 118, which is applicable to the right armhole 119.

When the front body 110 and the rear body 120 are separated along the seams, the left armhole 118 is divided into a front segment 310 and a rear segment 320. The front segment 310 is located at the upper left side of the front body 110 (which is shown in FIG. 3 at the upper right side thereof) and includes a left deeply-cut portion 311 and an upper-left side portion 312. The left deeply-cut portion 311 is shaped like a curve remained after the upper left corner of the front body 110 is deeply cut off (cf. FIG. 3) and is to be sewn on the front surface of the left connecting portion 135 (cf. FIG. 1). The upper-left side portion 312 is a portion constituting an upper end of the left side seam 113 of the body and to be sewn on the rear surface of the left connecting portion 135 (cf. FIG. 2). The rear segment 320 of the left armhole 118 is located at the upper left side of the rear body 120 and is shaped like a curve remained after the upper left corner of the rear body 120 is deeply cut off (cf. FIG. 3). Hereinafter, the rear segment 320 is also referred to as "left deeply-cut portion of the rear body 120." The entirety of the left deeply-cut portion 320 of the rear body 120 is to be sewn on the rear surface of the left connecting portion 135 (cf. FIG. 2).

The front segment 310 of the left armhole 118 is sewn on both the front and rear surfaces of the left connecting portion 135, while the rear segment 320 of the left armhole 118 is sewn on only the rear surface of the left connecting portion 135. This difference causes the lowest point STP of the seam between the front surface of the left connecting portion 135 and the front body 110 to be located at a height LUP above the lowest point LWP of the boundary between the rear surface of the left connecting portion 135 and the body 110, 120. The height LUP, preferably, ranges from 1 cm to 20 cm, inclusive. This height LUP prevents the restricting portion 128 from exerting a tensile force directly on the lowest point STP of the seam between the front surface of the left connecting portion 135 and the front body 110. As a result, in a vicinity of the lowest point STP, i.e. a region below the wearer's left armpit, esp. a rear side of the region, the fabric experiences a relatively reduced imbalance of tensile forces indifferent directions, and thus, the fabric hardly wrinkles. This reduces an amount of wrinkled fabric that cuts into the wearer's armpit.

Figure 4:
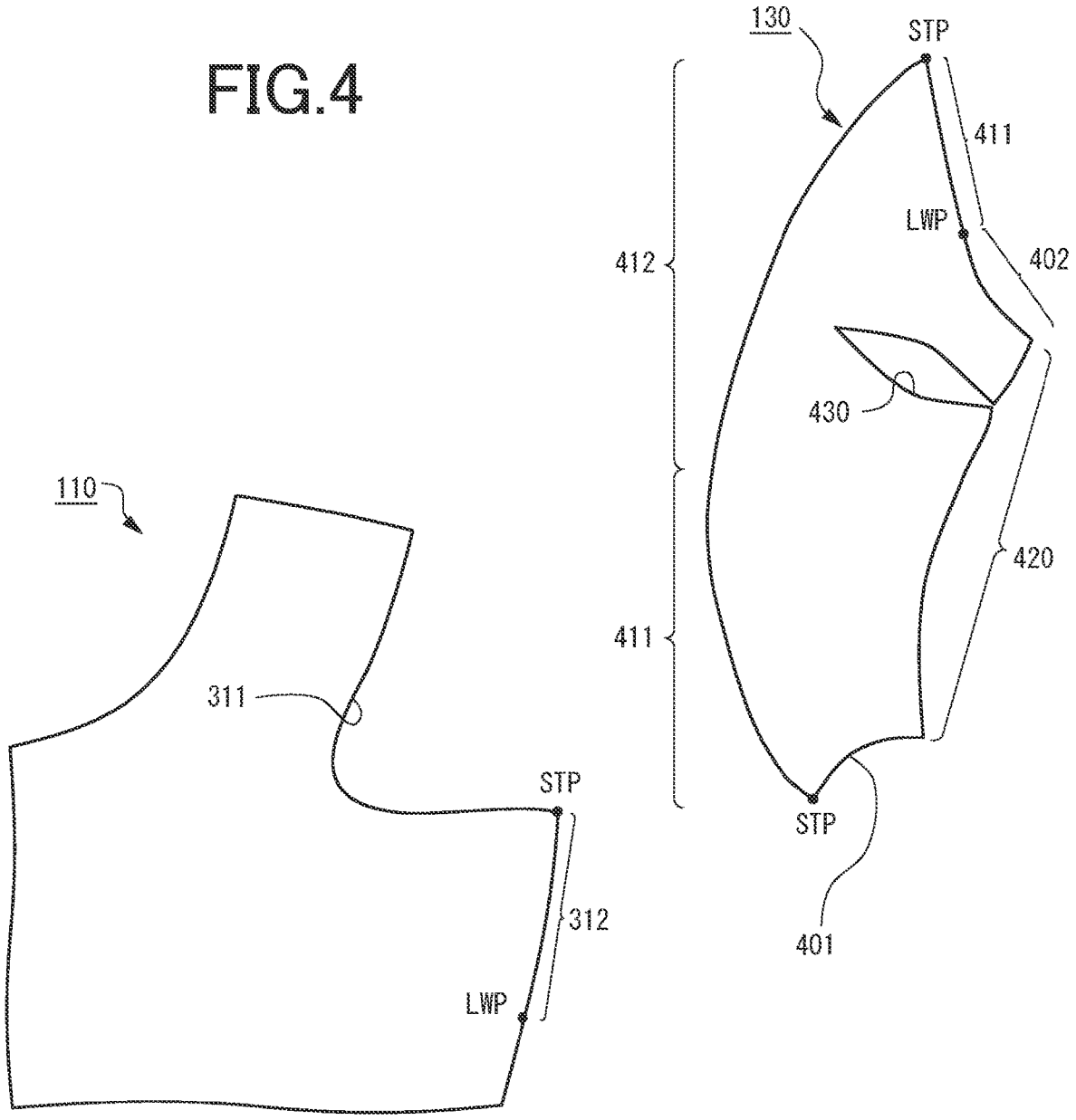
FIG. 4 is a development view of the left sleeve and the left armhole and its vicinity in the front body shown in FIG. 1.
Figure 5:
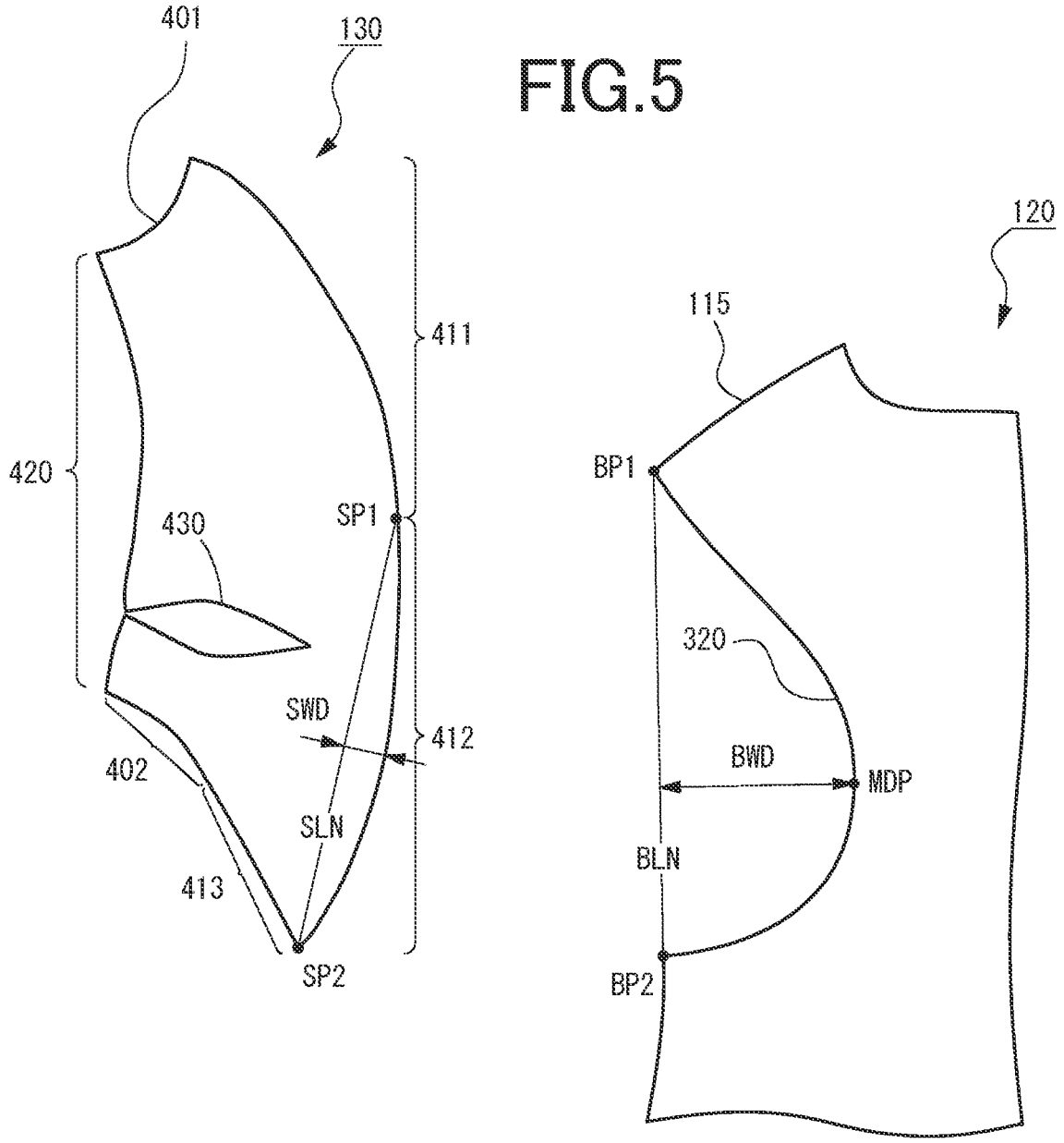
FIG. 5 is a development view of the left sleeve and the left armhole and its vicinity in the rear body shown in FIG. 2.

FIG. 4 is a development view of the left sleeve 130 and the left armhole 118 and its vicinity in the front body 110. FIG. 5 is a development view of the left sleeve 130 and the left armhole 118 and its vicinity in the rear body 120. Since development views of the right sleeve 140 and the right armhole 119 and its vicinity in the body are equivalent to mirror images of FIGS. 4 and 5, the following will explain the left sleeve 130 and the left armhole 118, which is applicable to the right sleeve 140 and the right armhole 119.

The left sleeve 130 has a structure consisting of a cylindrically rolled fabric. More concretely, in the boundary line of fabric constituting the left sleeve 130 shown in FIGS. 4 and 5, a first underarm line 401 and a second underarm line 402 are sewn on each other to form the underarm seam 134 of the left sleeve 130 (cf. FIGS. 1 and 2). The underarm seam 134 thus divides the remaining boundary line of the left sleeve 130 into a first curve group 411, 412, 413 and a second curve group 420. Segments 411 and 412 of the first curve group constitute a sleeve cap line of the left sleeve 130. The front segment 411 of the sleeve cap line is sewn on the left deeply-cut portion 311 of the front body 110 (cf. FIG. 4), and the rear segment 412 of the sleeve cap line (which is hereinafter referred to as "rear sleeve cap line") is sewn on the left deeply-cut portion 320 of the rear body 120 (cf. FIG. 5). The remaining segment 413 of the first curve group is sewn on the upper-left side portion 312 of the front body 110 to constitute an upper portion of the left side seam 113 (i.e. a section from the point STP to the point LWP, cf. FIG. 2). The second curve group 420 constitutes the cuff 133 of the left sleeve 130 (cf. FIGS. 1 and 2).

As shown in FIG. 2, different points on the left deeply-cut portion 320 of the rear body 120 are different distances from a center line CTL that bisects the rear body 120 in a right and left direction. A section MDP of the left deeply-cut portion 320 farthest from a straight line BLN connecting both ends BP1 and BP2 of the left deeply-cut portion 320 (cf. FIG. 5) is referred to as "deepest section". The deepest section MDP of the left deeply-cut portion 320 is located to the right of the leftmost portion of the left shoulder seam 115 of the rear body 120, i.e. the right of the upper end BP1 of the left deeply-cut portion 320. Compared to such a large curvature of the left deeply-cut portion 320, the rear sleeve cap line 412 of the left sleeve 130 has a smaller curvature. That is, before the left sleeve 130 is sewn on the rear body 120, a width SWD of the rear sleeve cap line 412 is smaller than a width BWD of the left deeply-cut portion 320: SWD<BWD; the width SWD of the rear sleeve cap line 412 is the maximum distance of the rear sleeve cap line 412 from a straight line SLN connecting both ends SP1 and SP2 of the rear sleeve cap line 412, and the width BWD of the left deeply-cut portion 320 is the distance of the deepest section MDP from a straight line BLN connecting both the ends BP1 and BP2 of the left deeply-cut portion 311. Due to such a relationship of these widths SWD and BWD, the rear sleeve cap line 412 cannot reach the left deeply-cut portion 320 until stretched to the right. As a result, the left sleeve 130, once sewed on the rear body 120, is naturally pitched more backward than the rear body 120.

Figure 6:
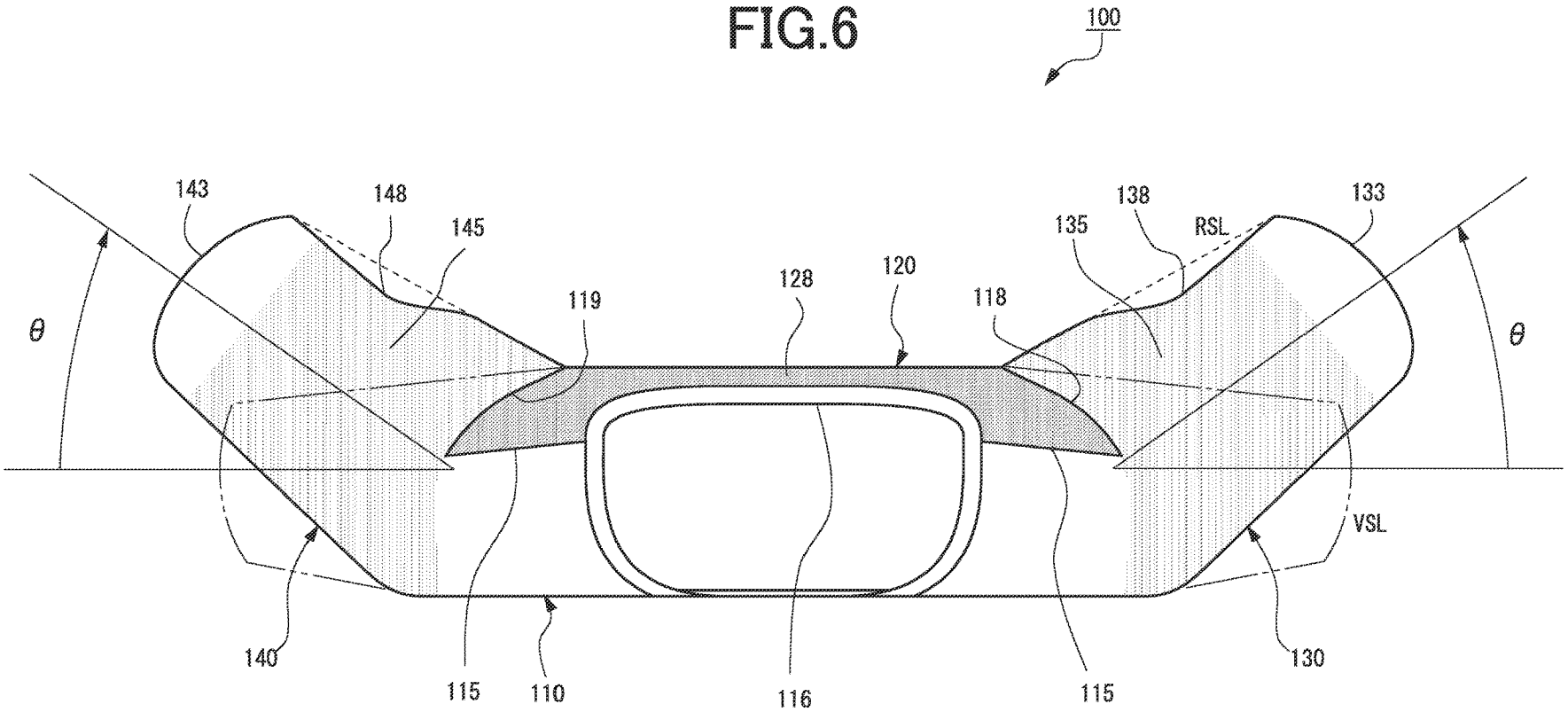
FIG. 6 is a plan view of a solid shape of the upper body of the garment shown in FIG. 1.

FIG. 6 is a plan view of a solid shape of the garment upper body 100. The "solid shape" of a garment means a three-dimensional shape of the garment when inflated with no portions stretched or folded. Solid shapes are generally designed to wrap and fit standard shapes of human body. As shown in FIG. 6, in the solid shape of the garment upper body 100, the direction of the left connecting portion 135 is tilted more backward than the direction of a standard left connecting portion. Thus, the solid shape of the entirety of the left sleeve 130 is tilted backward (diagonally backward left) at an angle θ relative to the solid shape of a left sleeve wrapping the left arm of a standard human body (cf. dashed-two dotted lines VSL shown in FIG. 6). The same is true for the right sleeve 140. Since tilted backward in such a manner, both the sleeves 130 and 140 pull shoulder blades, upper portions of upper arms, and shoulders of a wearer of the garment upper body 100 backward and toward the center of his/her back. Accordingly, it is difficult for the wearer to adopt the posture in which the shoulders extend forward to put the arms in front of the trunk.

As shown in FIGS. 4 and 5, before three-dimensional sewing, the rear surface of the left connecting portion 135 has a hole 430 in an elongated rhombus shape. This hole 430 is closed by sewing, and then a dart 137 forms on the rear surface of the left connecting portion 135 (cf. FIG. 2). In addition, a recess 138 appears, which has a rhombus shape with its longitudinal axis aligned with the direction of the dart 137 (cf. FIGS. 2 and 6). (A broken line RSL shown in FIG. 6 indicates where the rear surface of the left sleeve 130 is located if it does not have the dart 137.) The recess 138 protrudes to the inside of the left sleeve 130. As shown in FIG. 2, the dart 137 extends along the longitudinal direction LDL of the left sleeve 130, and thus, the recess 138 is longer in the longitudinal direction LDL of the left sleeve 130 than in a circumferential direction thereof. Since the wearer with the good posture, when moving the left arm forward, has to first stretch and flatten the recess 138, the left arm experiences resistance, which prevents the left arm from involuntarily moving forward from the position in the good posture. The same is true for the right arm. Accordingly, it is difficult for the wearer to adopt the posture in which the shoulders extend forward to put the arms in front of the trunk.

A region of the left sleeve 130, at least the rear surface of the left connecting portion 135 is a hardly- or non-stretchy region. The "hardly-stretchy region" is a region whose fabric is hardly stretched, or more concretely, a region stretched by 20% in the longitudinal direction LDL of the left sleeve 130 when experiencing a stretching force in the same direction ranging from 45 cN to 600 cN, inclusive, or preferably ranging from 60 cN to 500 cN, inclusive, or more preferably, ranging from 80 cN to 400 cN, inclusive. The "non-stretchy region" is a region whose fabric is almost or substantially inextensible, or more concretely, a region stretched in the longitudinal direction LDL of the left sleeve 130 by less than 20%, or more preferably less than 10%, when experiencing a stretching force of 45 cN in the same direction. The hardly- or non-stretchy region of the left sleeve 130 may range from the rear surface of the left connecting portion 135 to the front surface thereof. According to these structures, at least the rear surface of the left connecting portion 135 generates a higher reaction force against an external tensile force, thus hardly or never reducing both the resistance caused by flattening the recess 138 thereof and the tensile force of the restricting portion 128 of the rear body 120. As a result, the garment upper body 100 can effectively prevent the forward motion of the wearer's shoulder blades, upper arms, and shoulders. The same is true for the right sleeve 140.

<Modifications>

(A) The garment upper body 100 according to the embodiment is the shirt including the front body 110 and the rear body 120. However, the front body 110 may be omitted, i.e. the garment upper body may be a garment consisting of only the sleeves 130, 140 and the rear body 120. Even in this case, the garment upper body can achieve the effect of correcting the wearer's posture.

(B) The restricting portion of the rear body 120 is not limited to the region 128 between the rear surfaces of the left sleeve 130 and the right sleeve 140, but it may consist of a larger region or the entirety of the rear body 120. Conversely, the restricting portion 128 may be omitted. Even with no tensile force of the restricting portion 128, the resistance caused by flattening the recesses 138 of both the sleeves 130 and 140 can make it difficult for a wearer to adopt the posture in which the shoulders extend forward to put the arms in front of the trunk.

(C) The developed shapes of the armholes 118 and 119 may have more rectilinear peripheries. In this case, the angle θ shown in FIG. 6 is substantially equal to zero, i.e. both the sleeves 130 and 140 extend perpendicularly to the body 110 and 120. Even so, presence of the resistance caused by flattening the recesses 138 of the sleeves 130 and 140 can make it difficult for a wearer to adopt the posture in which the shoulders extend forward.

(D) In the example shown in FIGS. 3, 4, and 5, the body 110, 120 and the sleeves 130, 140 are separately woven and then sewn on each other. Alternatively, combination of some or all of them may be integrally woven.

(E) In FIG. 2, the dart 137 extends from the cuff 133 of the left sleeve 130 to the rear surface of the left connecting portion 135. Alternatively, the dart 137 may extend throughout the entire length of the left sleeve 130, i.e. to the left armhole 118 of the body.

Figure 7A:
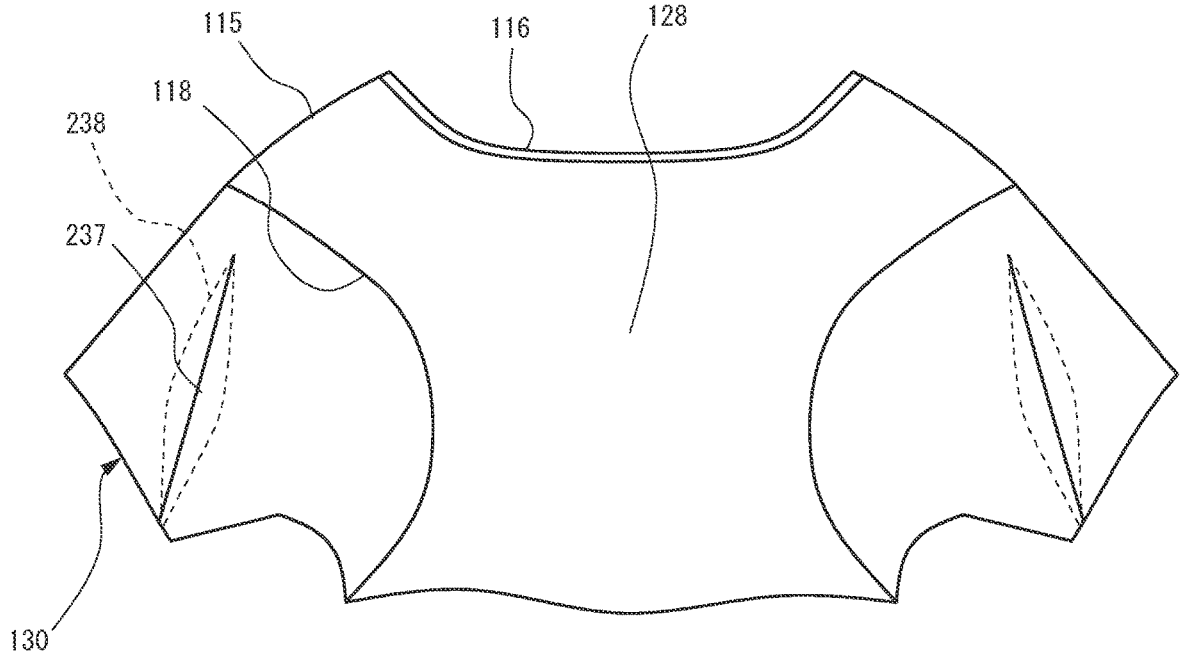
FIG. 7A is a rear elevation view of the upper body of the garment including substantially vertical darts.
Figure 7B:
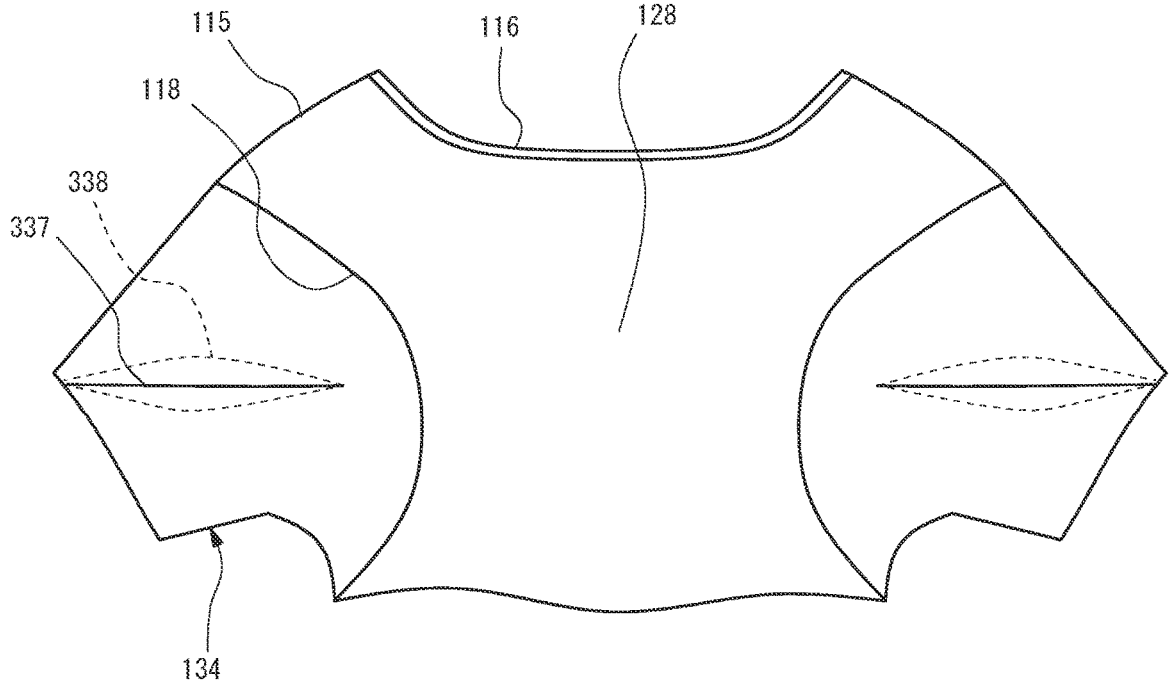
FIG. 7B is a rear elevation view of the upper body of the garment including substantially horizontal darts.

(F) In FIG. 2, the direction in which the dart 137 or the longitudinal axis of the recess 138 extends is parallel to the longitudinal direction LDL of the left sleeve 130. Alternatively, the longitudinal axis may be tilted relative to the longitudinal direction of the sleeve. FIG. 7A is a rear elevation view of the garment upper body 100 including substantially vertical darts 237, and FIG. 7B is a rear elevation view of the garment upper body 100 including substantially horizontal darts 337. Any of the darts 237 and 337 is largely tilted relative to the longitudinal direction of the left sleeve 130. Even in these cases, a wearer's left arm experiences sufficiently high resistance when flattening the recess 238 or 338. The same is true for the right sleeve 140. Accordingly, the garment upper body 100 can make it difficult for the wearer to adopt the posture in which the shoulders extend forward.

In view of the explanation described above, the invention can obviously have many variations and modifications. Accordingly, it should be understood that, within the scope of the claims attached to the specification, the invention can have embodiments other than those described in the specification.

DESCRIPTION OF REFERENCE SYMBOLS

100 upper body of garment, 110 front body, 113 left side seam, 114 right side seam, 115 shoulder seam, 116 neckline, 117 hem, 118 left armhole, 119 right armhole, 120 rear body, 128 restricting portion, 130 left sleeve, 133 cuff of left sleeve, 134 underarm line of left sleeve, 135 left connecting portion, 137 dart of left sleeve, 138 recess of left sleeve, 140 right sleeve, 143 cuff of right sleeve, 144 underarm line of right sleeve, 145 right connecting portion, 147 dart of right sleeve, 148 recess of right sleeve.

What is claimed is:

1. An upper body of a garment, the upper body comprising:

a body including at least a rear body;

a left sleeve including a left connecting portion connected to a left side of the body; and a right sleeve including a right connecting portion connected to a right side of the body, wherein:

a rear surface of the left connecting portion has a left recess formed by a dart and protruding toward an inside of the left sleeve, when the upper body is in a solid shape configuration;

a rear surface of the right connecting portion has a right recess formed by a dart and protruding toward an inside of the right sleeve, when the upper body is in the solid shape configuration;

a length of the left recess in a longitudinal direction of the left sleeve is longer than a width of the left recess in a circumferential direction of the left sleeve; and, a length of the right recess in a longitudinal direction of the right sleeve is longer than a width of the right recess in a circumferential direction of the right sleeve.

2. The upper body according to claim 1, wherein:

the left sleeve includes a hardly-stretchy region that, when being stretched by 20% in the longitudinal direction of the left sleeve, increases a stretching force to 45 cN or more in the same direction and that extends at least within the rear surface of the left connecting portion; and the right sleeve includes a hardly-stretchy region that, when being stretched by 20% in the longitudinal direction of the right sleeve, increases a stretching force to 45 cN or more in the same direction and that extends at least within the rear surface of the right connecting portion.

3. The upper body according to claim 2, wherein:

the hardly-stretchy region of the left sleeve ranges from the rear surface of the left connecting portion to a front surface of the left connecting portion; and the hardly-stretchy region of the right sleeve ranges from the rear surface of the right connecting portion to a front surface or of the right connecting portion.

4. The upper body according to claim 3, wherein the left and right connecting portions each extend backward from the rear body.

5. The upper body according to claim 3, wherein the rear body includes a restricting portion located between the rear surfaces of the left and right connecting portions and adapted to prevent left and right shoulder blades of a wearer from moving apart from each other.

6. The upper body according to claim 2, wherein the left and right connecting portions each extend backward from the rear body.

7. The upper body according to claim 2, wherein the rear body includes a restricting portion located between the rear surfaces of the left and right connecting portions and adapted to prevent left and right shoulder blades of a wearer from moving apart from each other.

8. The upper body according to claim 1, wherein:

the left sleeve includes a non-stretchy region that is stretched by less than 20% in the longitudinal direction of the left sleeve when experiencing a stretching force of 45 cN or more in the same direction and that extends at least within the rear surface of the left connecting portion; and the right sleeve includes a non-stretchy region that is stretched by less than 20% in the longitudinal direction of the right sleeve when experiencing a stretching force of 45 cN or more in the same direction and that extends at least within the rear surface of the right connecting portion.

9. The upper body according to claim 8, wherein:

the non-stretchy region of the left sleeve ranges from the rear surface of the left connecting portion to a front surface of the left connecting portion; and the non-stretchy region of the right sleeve ranges from the rear surface of the right connecting portion to a front surface of the right connecting portion.

10. The upper body according to claim 9, wherein the left and right connecting portions each extend backward from the rear body.

11. The upper body according to claim 9, wherein the rear body includes a restricting portion located between the rear surfaces of the left and right connecting portions and adapted to prevent left and right shoulder blades of a wearer from moving apart from each other.

12. The upper body according to claim 8, wherein the left and right connecting portions each extend backward from the rear body.

13. The upper body according to claim 8, wherein the rear body includes a restricting portion located between the rear surfaces of the left and right connecting portions and adapted to prevent left and right shoulder blades of a wearer from moving apart from each other.

14. The upper body according to claim 1, wherein the left and right connecting portions each extend backward from the rear body.

15. The upper body according to claim 14, wherein the rear body includes a restricting portion located between the rear surfaces of the left and right connecting portions and adapted to prevent left and right shoulder blades of a wearer from moving apart from each other.

16. The upper body according to claim 1, wherein the rear body includes a restricting portion located between the rear surfaces of the left and right connecting portions and adapted to prevent left and right shoulder blades of a wearer from moving apart from each other.

* * * * *